US010072623B2

(12) United States Patent
Mayer et al.

(10) Patent No.: US 10,072,623 B2
(45) Date of Patent: Sep. 11, 2018

(54) ARRANGEMENT FOR A FUEL INJECTION SYSTEM WITH A FUEL INJECTION VALVE AND A DECOUPLING ELEMENT

(71) Applicant: Robert Bosch GmbH, Stuttgart (DE)

(72) Inventors: Michael Mayer, Wannweil (DE); Martin Scheffel, Vaihingen (DE); Martin Maier, Moeglingen (DE); Michael Knorpp, Weissach (DE); Pablo Antonio Napal Jimenez, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 351 days.

(21) Appl. No.: 14/436,806

(22) PCT Filed: Sep. 24, 2013

(86) PCT No.: PCT/EP2013/069817
§ 371 (c)(1),
(2) Date: Apr. 17, 2015

(87) PCT Pub. No.: WO2014/079609
PCT Pub. Date: May 30, 2014

(65) Prior Publication Data

US 2016/0169176 A1 Jun. 16, 2016

(30) Foreign Application Priority Data

Nov. 20, 2012 (DE) ..... 10 2012 221 134

(51) Int. Cl.
*F02M 61/12* (2006.01)
*F02M 61/14* (2006.01)

(52) U.S. Cl.
CPC ..... *F02M 61/12* (2013.01); *F02M 61/14* (2013.01); *F02M 2200/09* (2013.01); *F02M 2200/26* (2013.01); *F02M 2200/8023* (2013.01)

(58) Field of Classification Search
CPC ..... F02M 61/12; F02M 61/14; F02M 69/042; F02M 2200/8023; F02M 2200/26; F02M 2200/09; F02M 2200/85; F02M 2200/853
(Continued)

(56) References Cited

U.S. PATENT DOCUMENTS 6,446,978 B1 * 9/2002 Halling ..... F16J 15/0887 277/314
7,373,925 B2 * 5/2008 Reiter ..... F02M 61/167 123/467
(Continued)

FOREIGN PATENT DOCUMENTS

CN 1446288 A 10/2003
DE 19600403 1/1996
(Continued)

OTHER PUBLICATIONS

International Search Report for PCT/EP2013/069817, dated Nov. 18, 2013.

*Primary Examiner* — Grant Moubry
(74) *Attorney, Agent, or Firm* — Norton Rose Fulbright US LLP; Gerard Messina

(57) ABSTRACT

A decoupling element, for decoupling a fuel injection valve from a cylinder head, includes a body that, in the mounted state, surrounds a housing of the fuel injection valve. The body is fashioned to include a cylinder-side support region to be supported on the cylinder head, and a valve-side support region for supporting the fuel injection valve. When the fuel injection valve is supported at the valve-side support region, the body is loaded with pressure. Only the cylinder-
(Continued)

side support region of the body is fashioned in the shape of a closed ring, which connects segments of the body distributed around a circumference. The decoupling element enables the reduction of the transmission of noise from the fuel injection valve to the cylinder head.

25 Claims, 4 Drawing Sheets

(58) Field of Classification Search
USPC ..... 123/467, 470
See application file for complete search history.

(56) References Cited

U.S. PATENT DOCUMENTS 7,823,565 B2 * 11/2010 Chern ..... F02M 55/004 123/192.1
7,832,376 B2 * 11/2010 Mueller ..... F02M 61/14 123/470
8,763,588 B2 * 7/2014 Sugiyama ..... F02M 61/14 123/470
8,875,683 B2 * 11/2014 Holt ..... F16F 1/328 123/470
2005/0066941 A1 * 3/2005 Berger ..... F02M 61/14 123/470
2009/0235898 A1 * 9/2009 Short ..... F02M 53/046 123/470
2011/0000464 A1 1/2011 Kannan et al.

FOREIGN PATENT DOCUMENTS

DE 10338715 4/2005
DE 102008054591 6/2010
EP 2469069 6/2012

* cited by examiner

ARRANGEMENT FOR A FUEL INJECTION SYSTEM WITH A FUEL INJECTION VALVE AND A DECOUPLING ELEMENT

FIELD OF THE INVENTION

The present invention relates to a decoupling element that is used to decouple a fuel injection valve from a cylinder head, and to a system including a fuel injection valve and including such a decoupling element. Specifically, the present invention relates to the field of fuel injection systems in internal combustion engines, in which fuel under high pressure is injected via fuel injection valves into allocated combustion chambers of the internal combustion engine.

BACKGROUND

DE 103 38 715 A1 describes a compensating element used to mount a fuel injection valve in a cylinder head of an internal combustion engine. The compensating element is made with an annular shape, and is situated between a valve housing of the fuel injection valve and a wall of a receptacle bore of the cylinder head. The compensating element has limbs that are supported on the fuel injection valve and on the cylinder head. A first limb lies against a shoulder of the cylinder head. A second limb lies against a shoulder of the valve housing. Undercuts and cutouts can be provided on the compensating element. The compensating element can have segments that are stamped out from the compensating element and that are bent radially inward. In this way, the compensating element provides both a compensation of manufacturing tolerances of the individual components and also of tolerances that result from the heating of the fuel injection valve during operation, thus preventing twisting and faulty positioning. A disadvantage of this compensating element is that, when there is a large enough load, tensions occur around the circumference of the material that can cause cracks at the circumference and can ultimately result in failure of the compensating element.

DE 10 2008 054 591 A1 describes a decoupling element for a fuel injection device and through which a low-noise design is realized. The spring rigidity of the decoupling element is selected to be low enough, and the decoupling element is placed in such a way that the decoupling resonance is in the frequency range below 2.5 kHz. In a possible embodiment, a possible misalignment of a fuel injection valve is corrected by a local weakening of an inner support region of the decoupling element. This local weakening of the radially inner support region is achieved through slits that run radially, going out from the inner diameter of the decoupling element for example up to the inner radius. Typically, such slits, or also other openings that reduce rigidity, can be provided in a number of from 3 to 20. A disadvantage of this decoupling element is that it is constructed in the manner of a plate spring, and is loaded with tensile stress in the mounted state. Over its lifespan, the problem thus arises of ensuring adequate component strength and at the same time ensuring the desired noise reduction.

SUMMARY

An advantage of the decoupling element and system according to example embodiments of the present invention is that an improved vibration damping is ensured over the lifespan thereof. Specifically, the advantage results in an adequate noise damping being ensured even after a long duration of operation, and premature component failure is avoided.

With the proposed decoupling element, the transmission of noise from the fuel injection valve to the cylinder head can be reduced easily, in as small a constructive space as possible, and at low additional cost. A specified target rigidity can be maintained, for example less than 50 kN/mm. The associated operating strength, required in particular when there are high system pressures, as for example in the case of direct gasoline injection, can be ensured. Vibrational isolation, decoupling, and a decoupling of structure-borne sound can be ensured.

Rotationally symmetrical designs, as in the case of plate springs, in a decoupling element for high system pressures and associated large axial loads, in connection with the very small available constructive space, develop large circumferential tensions that cause cracks at the circumference and ultimately result in failure of the component, due to acting forces and the deformations caused thereby. A conceivable solution is to counter these problems by increasing the wall thickness. However, the required decoupling rigidity can then no longer be ensured due to the massive construction of these elements for tension reduction.

According to the present invention, the problem of circumferential tensions can be limited by a specific segmenting that entails a breaking of the rotational symmetry. The decoupling rigidity then results through the sum of the rigidities of the individual segments distributed around the circumference. This corresponds to a connection in parallel of flexible springs. The segments acting as individual flexible elements are held together only by a comparatively small circumferential closed ring of the cylinder-side support region of the base body. In this way, on the one hand a better elasticity of the segments is achieved because they are made comparatively large and thus can be made with a comparatively thicker material for a specified target rigidity. On the other hand, the mechanical circumferential tensions are concentrated at the cylinder-side support region of the main body, which contributes nothing to the spring characteristic and can therefore be designed with regard to the required circumferential forces.

The advantage of this specific segmenting into the individual segments acting as flexible elements is thus also that, while maintaining the required rigidity values, significantly lower loads occur in the component, so that the strength requirements placed on the material are lower.

A further advantage is that the function of the tolerance compensating element necessary for transverse force compensation can be integrated into the shape of the segments (bending elements). Through a spherical or similar shaping of the segments, the fuel injection valve can be tilted on the decoupling element as on a ball joint, and in this way acting transverse forces and tolerance offsets between a midline of an installation bore at the cylinder head and a midline of an injector cup can be compensated.

Thus, the design according to the present invention, in which only the cylinder-side support region of the main body is realized at least partly in the form of a closed ring, has significant advantages. This design is to be understood such that, outside the cylinder-side support region, the main body is segmented into the segments distributed around the circumference. However, this also includes the possibility that the segments distributed around the circumference also extend partly into the cylinder-side support region of the main body. The cylinder-side support region of the main body is then realized only partly in the form of a closed ring.

The segments of the main body distributed around the circumference do not extend into the cylinder-side support region only if the cylinder-side support region of the main body is realized completely in the form of a closed ring.

It is advantageous for the main body to be loaded with pressure when the fuel injection valve is supported between the valve-side support region and the cylinder-side support region. In this way, the segments distributed around the circumference can advantageously act as bending segments. Here, relatively large bending movements are possible with regard to a specified maximum loading of the material. This makes possible, inter alia, an advantageous tolerance compensation with regard to the positioning of the fuel injection valve.

It is also advantageous that the closed ring of the cylinder-side support region includes bulges that extend radially outward, between the segments distributed around the circumference. It is further advantageous that the main body includes recesses that are provided between the segments of the main body, and that the recesses of the main body extend partly into the cylinder-side support region of the main body, so that the cylinder-side support region of the main body is realized only partly in the form of a closed ring. In this design, the segments of the main body distributed around the circumference also extend somewhat into the support region. In this way, a bending of the segments is further facilitated. The occurrent component tensions in the circumferential direction can also advantageously be concentrated onto the closed ring. The bulges that are provided between the segments distributed around the circumference, and that are thus also distributed around the circumference, ensure, in the region of the segments, a material cross-section sufficiently large to accept the forces acting in the circumferential direction. At the same time, the bending behavior of the segments is not influenced by the bulges. However, the support surface on the cylinder head can be enlarged by the bulges. Thus, the bulges enable an improved design with further advantages. Here it is also advantageous that the bulges of the closed ring bridge the recesses extending partly into the cylinder-side support region of the main body. In this design, the bulges also extend somewhat into the regions of the cylinder-side support region, which each terminates at both sides at the recesses in the circumferential direction. In this way, an advantageous introduction of force into the regions adjoining the recesses is achieved, and thus an advantageous force closure is achieved around the circumference.

It is also advantageous for the closed ring of the cylinder-side support region to be an at least substantially planar cylinder-side support region for the cylinder head. In this way, there results an advantageous support surface and a reliable positioning on the cylinder head.

It is also advantageous for there to be fashioned, at least at a segment of the valve-side support region, a securing element that, in the mounted state, works together with the housing of the fuel injection valve. In particular, a plurality of securing elements can be provided, each pre-tensioned in the radial direction against the housing of the fuel injection valve in order to form a captive securing. In this way, an advantageous mounting of the system, made up of the fuel injection valve and the decoupling element fastened thereon, is also possible.

In addition, it is advantageous that the closed ring of the cylinder-side support region is connected at least indirectly to a snap ring that, in the assembled state, works together with the housing of the fuel injection valve. This likewise provides the possibility of fastening the decoupling element on the fuel injection valve, for example in the context of pre-mounting. In this way, the system of the fuel injection valve and the decoupling element can easily be mounted on the cylinder head.

Preferred example embodiments of the present invention are described in more detail in the following description with reference to the accompanying drawings, in which corresponding elements are provided with the same reference characters.

DETAILED DESCRIPTION

Figure 1:
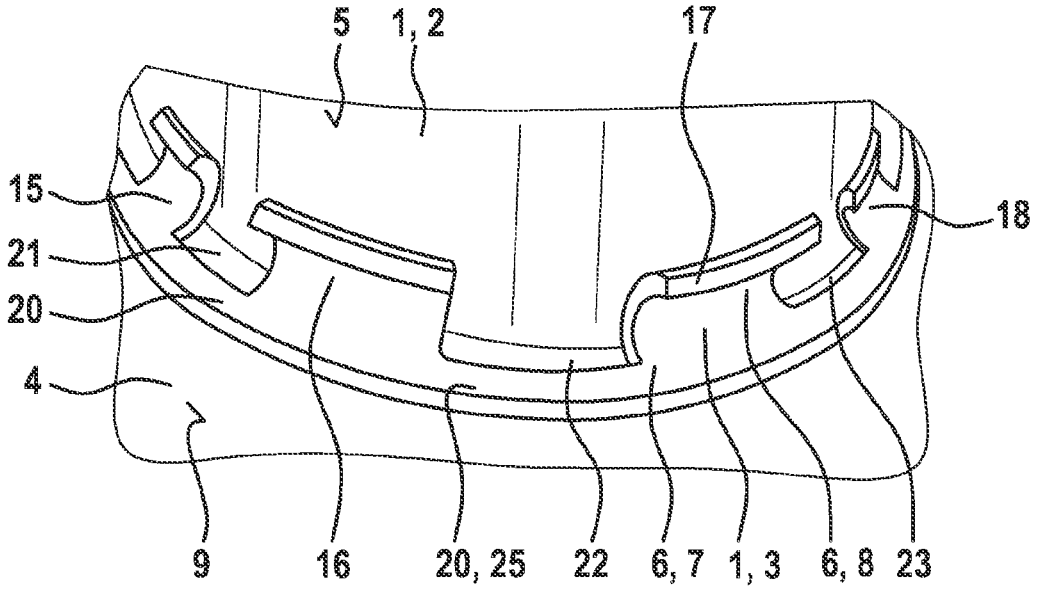
FIG. 1 shows a system including a fuel injection valve and a decoupling element, as well as a cylinder head, in a partial schematic spatial representation, according to a first example embodiment of the present invention.

FIG. 1 shows a system 1 including a fuel injection valve 2 and a decoupling element 3, and a cylinder head 4 in a partial, schematic, spatial representation, according to a first example embodiment of the present invention. System 1 is used in a fuel injection system in internal combustion engines. System 1 is suitable in particular for fuel injection systems for the direct injection of fuel into combustion chambers of the internal combustion engine. Specifically, the internal combustion engine can be realized as a mixture-compressing externally ignited internal combustion engine, injecting gasoline or other fuels suitable for such internal combustion engines, as well as suitable mixtures of such fuels.

Decoupling element 3 is particularly suitable for such applications.

Through system 1, or decoupling element 3, a reduction in the transmission of noise from fuel injection valve 2 to cylinder head 4 is possible.

For example, fuel injection valve 2 can be realized as an electromagnetic high-pressure injection valve 2, used in gasoline engines with direct injection. Without a decoupling element, there is the problem that fuel injection valve 2 makes a noticeable, disturbing contribution to the overall noise level of the engine. A noise that can be described as a valve ticking can for example arise from the rapid opening and closing of fuel injection valve 2, whenever a valve needle is displaced against its respective end stops with a high dynamic behavior. The impact of the valve needle on the end stops causes brief, very high contact forces that can in large part be transmitted via a housing 5 of fuel injection valve 2 to cylinder head 4 as structure-borne sound and vibrations. This then causes a strong development of noise at cylinder head 4, which however is significantly reduced by decoupling element 3, which is situated between cylinder head 4 and fuel injection valve 2.

However, in addition to the reduction of the development of noise, decoupling element 3 is also subject to the requirement that it provide the required decoupling rigidity and required strength over its lifespan, in particular given high system pressures, with reference to a small available constructive space. This is achieved by the realization of decoupling element 3 according to the present invention, described below on the basis of the example embodiments.

Decoupling element 3 includes a main body 6 with a cylinder-side support region 7 and a valve-side support region 8. Cylinder-side support region 7 provides support at an upper side 9 of cylinder head 4. Valve-side support region 8 supports fuel injection valve 2. In the mounted state, shown in FIG. 1, decoupling element 3 circumferentially surrounds housing 5 of fuel injection valve 2. Upper side 9 of cylinder head 4 is realized in this example embodiment as planar upper side 9.

Figure 5:
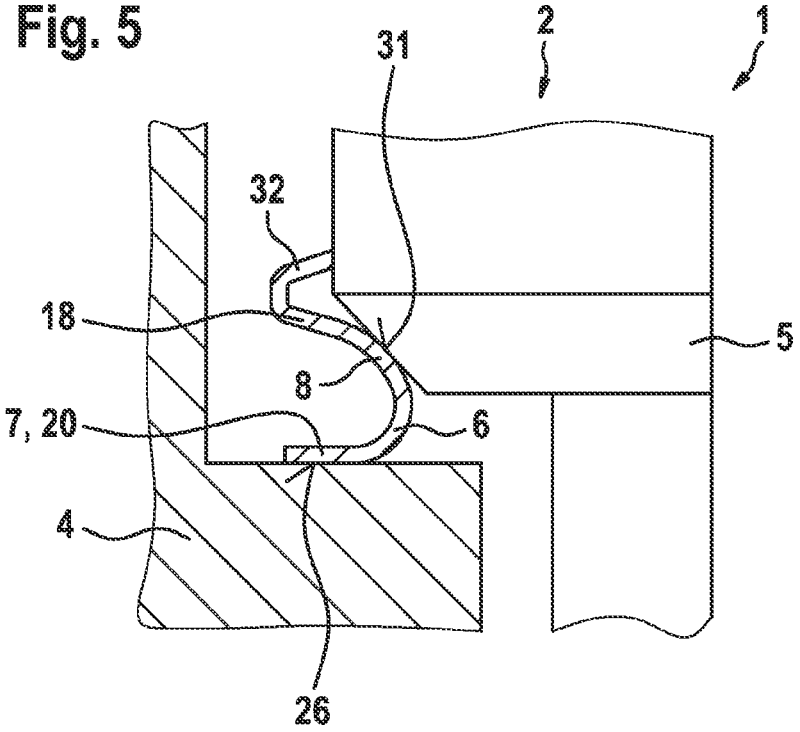
FIG. 5 shows a system including a fuel injection valve and a decoupling element, as well as a cylinder head, in a partial schematic sectional representation, corresponding to a fourth example embodiment of the present invention.

Main body 6 of decoupling element 3 is loaded with pressure when fuel injection valve 2 is supported between valve-side support region 8 and cylinder-side support region 7. Main body 6 includes segments 15, 16, 17, 18, that are distributed around the circumference and that are elastically bent when loaded. Through the segmenting of valve-side support region 8, an optimal elasticity over the life of the component is ensured, with regard to the specified material thickness. Tensions acting in the circumferential direction are significantly reduced by the segmenting in valve-side support region 8. In addition, cylinder-side support region 7 of main body 6 is realized at least partly in the shape of a closed ring 20. In this embodiment, only cylinder-side support region 7 of main body 6 is realized at least partly in the shape of closed ring 20. In this example embodiment, cylinder-side support region 7 of main body 6 is realized only partly in the form of a closed ring 20 because, between segments 15 through 18, recesses 21, 22, 23 are provided that also extend somewhat into cylinder-side support region 7. In this way, there remains, for example at recess 22, a web 25 of closed ring 20, in which cylinder-side support region 7, viewed in the circumferential direction, has a reduced radial extension of a planar support surface 26 (FIG. 5).

In this example embodiment, closed ring 20 of cylinder-side support region 7 is realized as planar cylinder-side support region 7 with a planar support surface 26 for cylinder head 4. In this way, a reliable positioning on cylinder head 4 is possible. This also improves the damping of vibrations, with a tolerance compensation that may be simultaneously required for fuel injection valve 2.

Recesses 21, 22, 23 extending into cylinder-side support region 7 are preferably maximal in size, so that the rest of the ring thickness at web 25 is reduced to the minimum possible.

Figure 2:
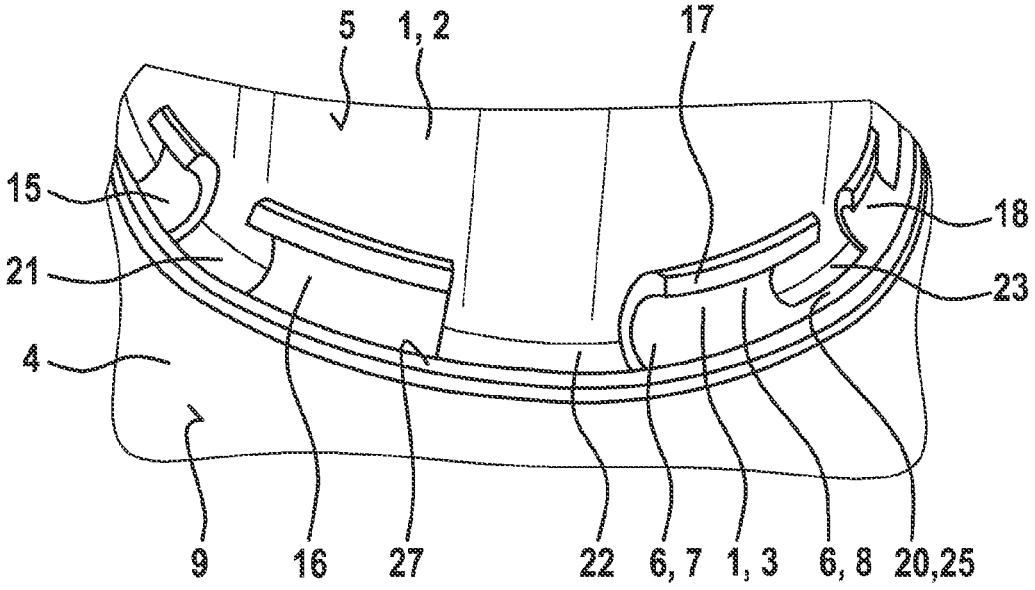
FIG. 2 shows the system and the cylinder head according to a second example embodiment of the present invention.

FIG. 2 shows a system 1 of FIG. 1 and cylinder head 4 according to a second example embodiment. In this example embodiment, an outer edge 27 of closed ring 20 is bent away from upper side 9 of cylinder head 4, from a direction of view oriented upward. With respect to the particular case of application, in this way, specifically in the case of narrow space conditions, a stability of closed ring 20 can be improved in particular at web 25.

Figure 3:
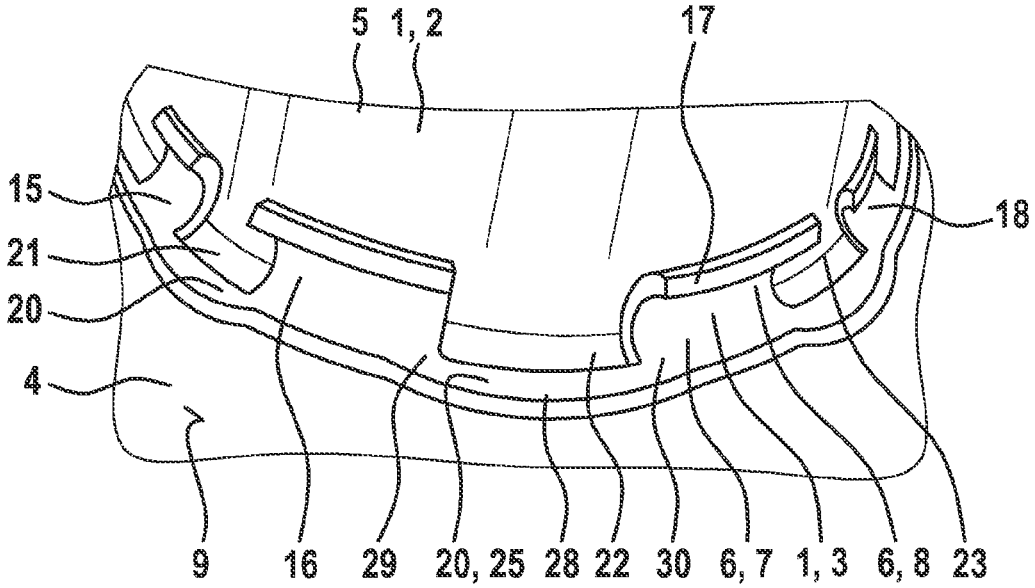
FIG. 3 shows the system and the cylinder head according to a third example embodiment of the present invention.

FIG. 3 shows system 1 and cylinder head 4 according to a third example embodiment, in which closed ring 20 of cylinder-side support region 7 has bulges 28 between segments 15 through 18 distributed around the circumference (for simplification of the representation, only bulge 28 is identified). Bulge 28 extends radially outward. In this example embodiment, support surface 26 of cylinder-side support region 7 is enlarged by bulge 28. Here, bulge 28 bridges recess 22, which extends partly into cylinder-side support region 7. This enlarges the cross-sectional surface that is important for accommodating the circumferential tensile forces, in particular in the region of web 25.

As a result, the corresponding tensile stresses are reduced. For this purpose, bulge 28 also extends into regions (zones) 29, 30 of cylinder-side support region 7 that adjoin recess 22 in the circumferential direction. Zones 29, 30 thus enable an advantageous force closure in closed ring 20.

Figure 4:
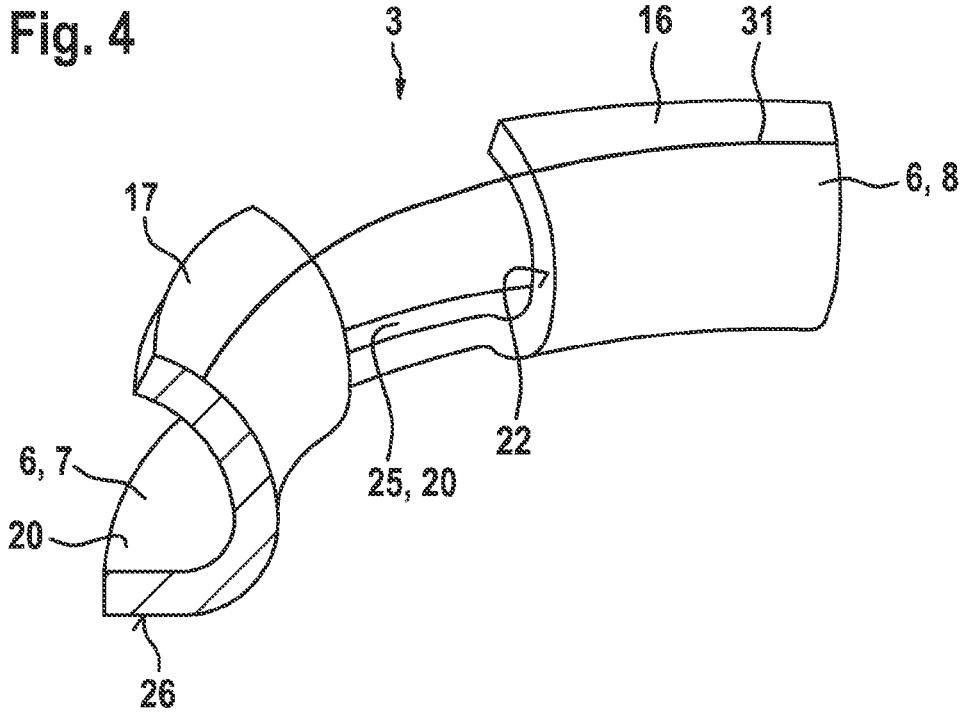
FIG. 4 shows the decoupling element of the system shown in FIG. 1 in a partial schematic spatial representation, for the illustration of the functioning of a possible realization of the present invention, according to the first example embodiment.

FIG. 4 shows decoupling element 3 of system 1 shown in FIG. 1, according to the first example embodiment of the present invention, in a partial schematic spatial representation for the illustration of the functioning of a possible realization of the present invention. The detail shown can for example be one-fourth of a possible embodiment. Upwardly bent segments 16, 17 are realized in the form of bent clips that provide seating or support for fuel injection valve 2 along line 31 drawn in as an illustration. Via this line (support line) 31, the load is transferred to decoupling element 3, due to the holding down and the pressure forces on the fuel injection valve. Due to the load, segments 16 through 18 bend. The overall rigidity of the decoupling then results from the sum of the individual bending rigidities. This corresponds to a connection in parallel of individual flexible springs. Due to the spherical shape of segments 15 through 18 acting as bending elements and the corresponding counter-contour on housing 5 of fuel injection valve 2, the function of a tolerance compensation, for compensating transverse forces and/or an offset caused by tolerances, is also integrated in the decoupling.

Depending on the application, through design optimization segments 15 through 18 can be fashioned in a suitable shape, number, and thickness in such a way that the desired rigidity is achieved with the required strength.

FIG. 5 shows a system 1 including a fuel injection valve 2 and a decoupling element 3, and a cylinder head 4, in a partial schematic sectional representation corresponding to a fourth example embodiment. Here, for illustration a segment 18 of main body 6 is shown in section. On segment 18, and on further segments not shown, valve-side support region 8 is fashioned, housing 5 being seated for example on line 31 of segments 18, as was also correspondingly described in relation to FIG. 4.

In addition, in this example embodiment, a securing element 32 is fashioned on segment 18. Further securing elements fashioned corresponding to securing element 32 are preferably fashioned on further segments that are not shown. In the depicted mounted state, securing element 32 works together with housing 5. When attached onto housing 5, securing element 32 can be expanded outward in the radial direction. In particular, here a grip into housing 5, in particular in a magnetic cup of housing 5, can be achieved through a specific shaping of securing element 32. In this way, a captive securing is formed.

Figure 6:
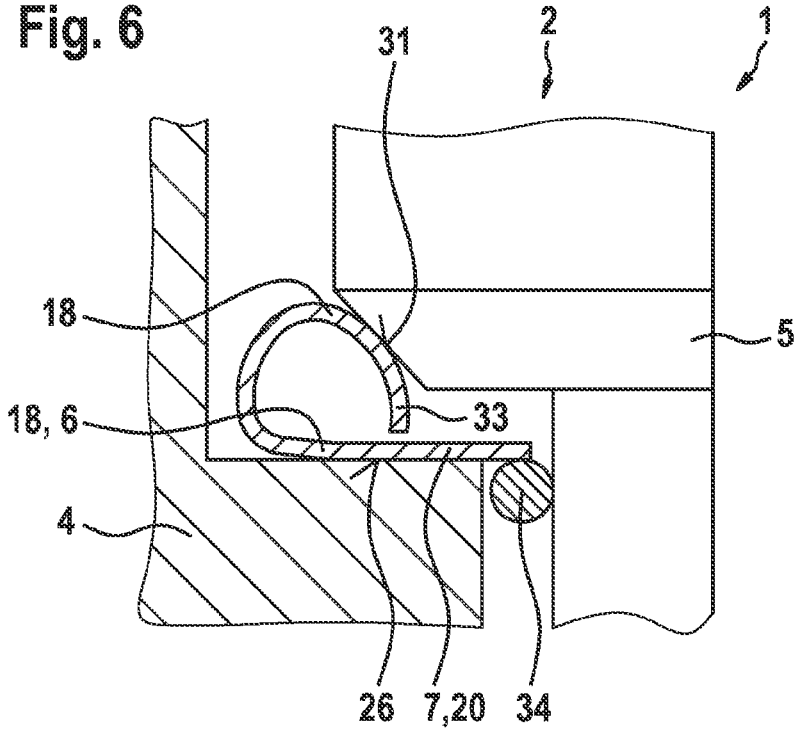
FIG. 6 shows the system of FIG. 5 and the cylinder head corresponding to a fifth example embodiment of the present invention.

FIG. 6 shows system 1 and cylinder head 4 corresponding to a fifth example embodiment, in which segment 18 is realized as an inwardly open segment 18. This design has the additional advantage that an end stop can be realized in order to limit the maximum deformation of segment 18. Here, a spacing element 33 is fashioned on segment 18 of valve-side support region 8, the spacing element facing the cylinder-side support region of main body 6. When valve-side support region 8 is pressed against cylinder-side support region 6, spacing element 33 meets cylinder-side support region 7, after a certain movement path. Thus, spacing element 33 then works together with the cylinder-side support region 6 in order to limit the possible range of movement.

In addition, in this example embodiment, a snap ring 34 is provided that works together with housing 5. Closed ring 20 of cylinder-side support region 7 is connected at least indirectly to snap ring 34, so that decoupling element 3 is reliably fastened on housing 5. This facilitates in particular a mounting of fuel injection valve 2 in cylinder head 4, because the coupling element 3 can be pre-mounted on fuel injection valve 2.

Figure 7:
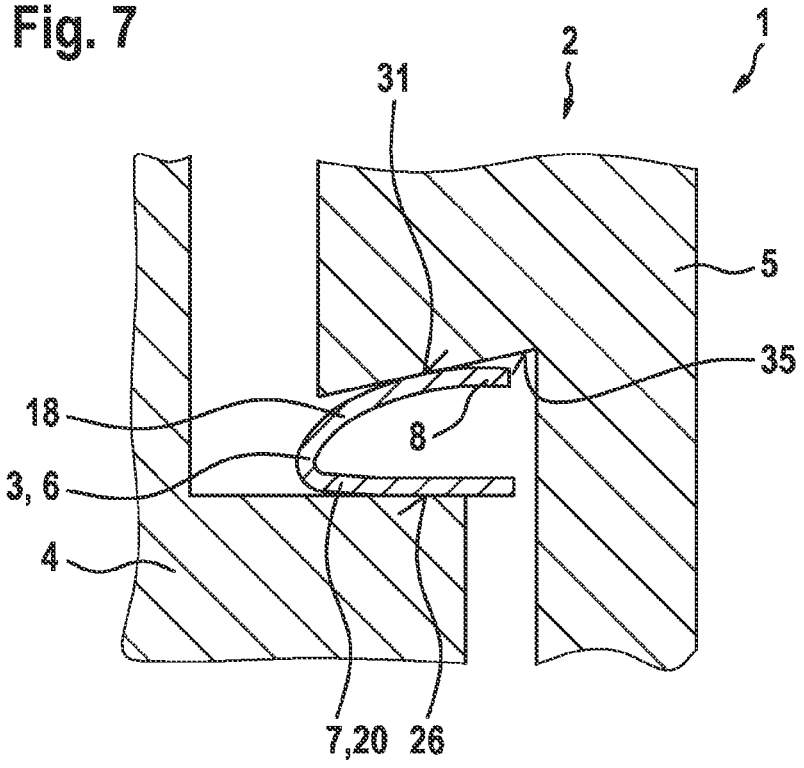
FIG. 7 shows the system of FIG. 5 and the cylinder head corresponding to a sixth example embodiment of the present invention.

Depending on the application, an outwardly open decoupling element 3, as described for example on the basis of FIGS. 1 through 4, and also an inwardly open decoupling element 3, as described on the basis of FIGS. 6 and 7, can be realized.

FIG. 7 shows system 1 and cylinder head 4 according to a sixth example embodiment, in which housing 5 of fuel injection valve 2 includes an undercut cone 35 at which fuel injection valve 2 is supported on valve-side support region 8 of decoupling element 3. Here, housing 5 lies with its undercut cone 35 against line 31 of valve-side support region 8. In this example embodiment, the design of decoupling element 3 is simplified.

In this way, a system 1 that is used for a fuel injection system in internal combustion engines can be realized, wherein, in the mounted state, fuel injection valve 2 is supported on cylinder head 4 of the internal combustion engine via decoupling element 3.

The present invention is not limited to the described example embodiments.

What is claimed is:

1. A decoupling element for decoupling a fuel injection valve from a cylinder head, the decoupling element comprising:

a main body that, in a mounted state, surrounds a housing of the fuel injection valve, and that includes a closed-ring section and a plurality of segments distributed about a circumference of, and connected to each other via, the closed-ring section, wherein:

the closed-ring section forms at least a part of a cylinder-side support region of the main body that, in the mounted state, is supported on the cylinder head;

at least respective parts of the plurality of segments form a valve-side support region that supports the fuel injection valve; and the closed-ring section includes, between respective pairs of the plurality of segments, respective bulges that extend radially outward.

2. The decoupling element of claim 1, wherein the main body includes respective recesses between the plurality of segments, and the recesses extend partly into the cylinder-side support region.

3. The decoupling element of claim 2, wherein respective ones of the bulges span respective ones of the recesses.

4. The decoupling element of claim 1, wherein the bulges are arranged so that they are not present in respective centers of respective circumferential extensions of respective ones of the plurality of segments of the pairs.

5. The decoupling element of claim 1, wherein the main body includes respective recesses that:

cut radially outward into an interior wall of the closed-ring section, extending partly into the cylinder-side support region; and are, with respect to a circumferential direction, between the plurality of segments.

6. The decoupling element of claim 5, wherein the bulges are bulging sections of an exterior wall of the closed-ring section.

7. The decoupling element of claim 6, wherein the recesses are circumferentially offset from the bulges.

8. A decoupling element for decoupling a fuel injection valve from a cylinder head, the decoupling element comprising:

a main body that, in a mounted state, surrounds a housing of the fuel injection valve, and that includes:

a closed-ring section;

a plurality of segments that are above the closed-ring section and are distributed about a circumference of, and connected to each other via, the closed-ring section; and a respective securing element that is fashioned on a top of each of at least one of the segments and that, in the mounted state, works together with the housing of the fuel injection valve to maintain the fuel injection valve in the mounted state;

wherein:

the closed-ring section forms at least a part of a cylinder-side support region of the main body that, in the mounted state, is supported on the cylinder head; and at least respective parts of the plurality of segments form a valve-side support region that supports the fuel injection valve.

9. The decoupling element of claim 8, wherein each of the at least one segment extends radially outward away from its point of attachment to the closed-ring section, and the respective securing element extends radially inward away from the respective segment on top of which the respective securing element is fashioned.

10. A decoupling element for decoupling a fuel injection valve from a cylinder head, the decoupling element comprising:

a main body that, in a mounted state, surrounds a housing of the fuel injection valve, and that includes (a) a closed-ring section formed about a central longitudinal axis of the main body and (b) a plurality of segments distributed about a circumference of, and connected to each other via, the closed-ring section, wherein:

the closed-ring section forms at least a part of a cylinder-side support region of the main body that, in the mounted state, is supported on the cylinder head;

at least respective parts of the plurality of segments form a valve-side support region that supports the fuel injection valve; and the closed-ring section is connected to a snap ring that works together with the housing so that the closed ring is thereby fastened on the housing.

11. The decoupling element of claim 10, wherein, when the valve-side support region supports the fuel injection valve, the main body is loaded with pressure.

12. The decoupling element of claim 10, wherein the closed-ring section forms a substantially planar region supported on the cylinder head in the mounted state.

13. The decoupling element of claim 10, wherein a respective spacing element is fashioned on each of at least one of the segments, and, when the valve-side support region is pressed against the cylinder-side support region, works together with the cylinder-side support region to limit a range of movement.

14. A system for an internal combustion engine, the system comprising:

a fuel injection valve; and a decoupling element via which the fuel injection valve is mountable, in a mounted state, to a cylinder head, wherein:

the decoupling element includes a main body that, in the mounted state, surrounds a housing of the fuel injection valve, and that includes a closed-ring section and a plurality of segments distributed about a circumference of, and connected to each other via, the closed-ring section;

the closed-ring section forms at least a part of a cylinder-side support region of the main body that, in the mounted state, is supported on the cylinder head;

at least respective parts of the plurality of segments form a valve-side support region that supports the fuel injection valve;

the housing includes a first section and a second section;

a cross-sectional width of the second section is less than a cross-section width of the first section;

an outer surface of the first section extends downward to surround a portion of an outer surface of the second section, thereby forming an undercut cone;

the decoupling element is arranged around the second section at least partly within the undercut cone; and a surface of the undercut cone of the fuel injection valve is supported on the valve-side support region.

15. A system for an internal combustion engine, the system comprising:

a fuel injection valve; and a decoupling element via which the fuel injection valve is mountable, in a mounted state, to a cylinder head, wherein:

the decoupling element includes a main body that, in the mounted state, surrounds a housing of the fuel injection valve, and that includes (a) a closed-ring section formed about a central longitudinal axis of the main body and (b) a plurality of segments distributed about a circumference of, and connected to each other via, the closed-ring section;

the closed-ring section forms at least a part of a cylinder-side support region of the main body that, in the mounted state, is supported on the cylinder head;

at least respective parts of the plurality of segments form a valve-side support region that supports the fuel injection valve; and the plurality of segments are above the closed-ring section, and a respective securing element is fashioned on top of each of at least one of the segments and, in the mounted state, works together with the housing of the fuel injection valve to maintain the fuel injection valve in the mounted state.

16. The system of claim 15, further comprising the cylinder head.

17. The system of claim 16, wherein, when the valve-side support region supports the fuel injection valve, the main body is loaded with pressure.

18. The system of claim 16, wherein the closed-ring section includes, between the respective ones of the plurality of segments, bulges that extend radially outward.

19. The system of claim 18, wherein the main body includes respective recesses between the plurality of segments, and the recesses extend partly into the cylinder-side support region.

20. The system of claim 19, wherein respective ones of the bulges span respective ones of the recesses.

21. The system of claim 16, wherein the closed-ring section forms a substantially planar region supported on the cylinder head in the mounted state.

22. The system of claim 16, further comprising a snap ring that, in the mounted state, works together with the housing of the fuel injection valve for fastening the closed-ring section onto the housing by connection of the closed-ring section to the snap ring.

23. The system of claim 16, wherein a respective spacing element is fashioned on each of at least one of the segments, and, when the valve-side support region is pressed against the cylinder-side support region, works together with the cylinder-side support region to limit a range of movement.

24. The system of claim 15, wherein:

each of the at least one segment extends upwards and radially outward away from its point of attachment to the closed-ring section and from the fuel injection valve; and the respective securing element extends radially inward away from the respective segment on top of which the respective securing element is fashioned and toward the fuel injection valve.

25. The system of claim 24, wherein:

the respective securing element extends radially inward away from the respective segment to a securing edge of the securing element; and the fuel injection valve includes:

an exterior wall against which the securing edge of the securing element abuts; and an exterior conical surface that tapers downward, radially inward from the exterior wall and that lies against supporting surfaces of the segments.

* * * * *